US006981480B2

(12) United States Patent
Oleksiewicz

(10) Patent No.: US 6,981,480 B2
(45) Date of Patent: Jan. 3, 2006

(54) REDUCING PRE-CYCLE WARM-UP FOR ELECTRONIC COMPONENTS

(75) Inventor: Radek Oleksiewicz, Riverwoods, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/675,464

(22) Filed: Sep. 30, 2003

(65) Prior Publication Data

US 2004/0112316 A1 Jun. 17, 2004

Related U.S. Application Data

(63) Continuation-in-part of application No. 10/317,326, filed on Dec. 12, 2002, now abandoned.

(51) Int. Cl.
*F02P 19/02* (2006.01)

(52) U.S. Cl. ..... 123/142.5 E; 123/179.6; 361/103

(58) Field of Classification Search ..... 123/142.5 E, 123/179.6; 361/103
See application file for complete search history.

(56) References Cited

U.S. PATENT DOCUMENTS

| | | | |
|---|---|---|---|
| 4,444,160 | A | 4/1984 | Steele |
| 4,591,691 | A | 5/1986 | Badali |
| 4,669,430 | A | 6/1987 | Reinold et al. |
| 5,727,384 | A | 3/1998 | Ma |
| 6,005,761 | A | 12/1999 | Izawa et al. |
| 6,059,197 | A | 5/2000 | Kurahashi et al. |
| 6,164,258 | A | 12/2000 | Petrovich et al. |
| 6,205,010 | B1 | 3/2001 | Ohsaka et al. |

*Primary Examiner*—Erick Solis
(74) *Attorney, Agent, or Firm*—Susan L. Lukasik; Dennis Kelly Sullivan; Jeffrey P. Calfa

(57) ABSTRACT

An apparatus for and method of utilizing the temperature of one electronic component (203) reduces pre-cycle warm-up of another component (107 or 113). For example, a temperature sensor (205) for a driver (203) of an electronic component (107 or 133), such as a glow plug or fuel injector coil, is utilized to determine when a temperature condition is exceeded. When that temperature condition is exceeded (305), pre-cycle warm-up for the electronic component associated with the component is reduced (311).

25 Claims, 2 Drawing Sheets

REDUCING PRE-CYCLE WARM-UP FOR ELECTRONIC COMPONENTS

This application is a continuation-in-part application of and claims the benefit of the filing date of U.S. patent application Ser. No. 10/317,326, filed Dec. 12, 2002, now abandoned, on behalf of the same inventor as the present application and assigned to the assignee hereof.

FIELD OF THE INVENTION

This invention relates to prevention of burn-out of electronic components, including but not limited to prevention of burn-out of electronic components due to pre-cycle in internal combustion engines.

BACKGROUND OF THE INVENTION

When internal combustion engines are cold, it is known to engage pre-cycle warm-up processes to help the engine warm up more quickly. For example, fuel injectors that are oil driven have injector coils that receive a series of short pulses to cause them to rapidly move the injector spool back and forth to loosen up the injector spool by warming it up. Similarly, a glow plug is utilized to warm up the cylinders of the engine to aid fuel ignition in a cold engine. In both situations, a significant amount of current is utilized to warm up the relevant parts of the engine and assist in making cold start-ups easier and faster.

Nevertheless, these pre-cycle processes are engaged whenever the engine is cranked and the temperature, such as ambient, oil, or coolant temperature, is below a predetermined temperature. If, for any reason, the engine does not turn over right away and the engine is cranked again, the pre-cycle processes are engaged again because the relevant temperature will not have changed considerably. If the engine is cranked too many times in a relatively short period of time, the repeated pre-cycle processes could cause the electronic components, such as the fuel injector coils or non-self-regulated glow plugs, to burn out.

Accordingly, there is a need for a method of warming up an internal combustion engine quickly without burning out the electronic components utilized to warm up the engine.

SUMMARY OF THE INVENTION

A method and apparatus for reducing pre-cycle warm-up is described. A temperature sensor arranged and constructed to determine a temperature of a driver capable of driving an electronic component. When the temperature of the driver exceeds a temperature condition, a driver controller reduces pre-cycle warm-up of the electronic component.

DESCRIPTION OF A PREFERRED EMBODIMENT

The following describes an apparatus for and method of utilizing the temperature of one electronic component to reduce pre-cycle warm-up of another component. For example, a temperature sensor for a driver of an electronic component, such as a glow plug or fuel injector coil, is utilized to determine when a temperature condition is exceeded. When that temperature condition is exceeded, pre-cycle warm-up for the electronic component associated with the component is reduced.

Figure 1:
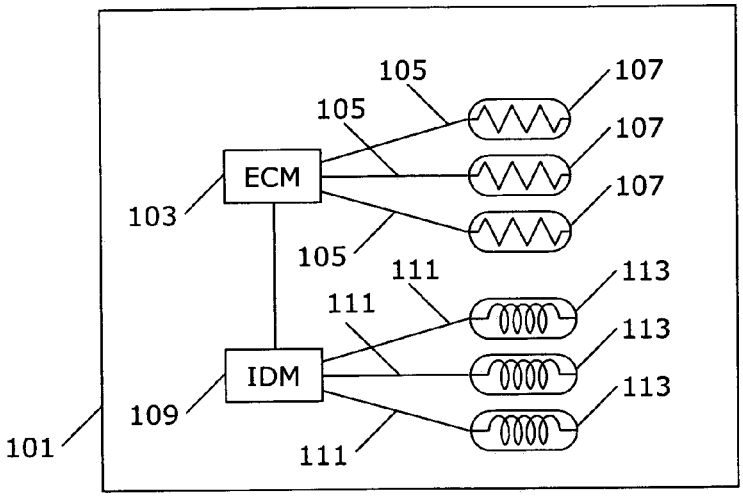
FIG. 1 is a block diagram illustrating driver controllers and a plurality of electronic components controlled by the driver controllers in accordance with the invention.

A block diagram illustrating driver controllers 103 and 109 and a plurality of electronic components 107 controlled by the driver controllers 103 and 109 are shown in FIG. 1. The example of FIG. 1 shows an internal combustion engine 101 with a first driver controller 103 that is an engine control module (ECM) 103 that interfaces with numerous sensors for the engine, e.g., temperature sensors and pressure sensors, and determines various control signals 105 for different engine components 107, such as fuel injectors, glow plugs, air intake heaters, fuel heaters, electromechanical devices requiring pre-cycling, and so forth. The example shown in FIG. 1 illustrates the path of control signals 105 utilized to control the turning on and off of glow plugs 107, for example, during the pre-cycle warm-up process for the engine cylinders.

The example of FIG. 1 shows an internal combustion engine 101 with a second driver controller 109 that is an injector driver module (IDM) 109. The ECM 103 also sends signals to other control modules, such as the IDM 109, for example, to control when and what signals are sent to the fuel injectors. The IDM may process and/or forward the signals from the ECM 103, and/or may generate its own signals to control the fuel injectors. As shown in FIG. 1, a plurality of injector control signals 111 are utilized to energize and de-energize the fuel injector coils that are part of fuel injectors 113. These signals 111 include fuel pulse signals that determine when fuel is delivered and how much fuel is delivered. These signals 111 also include the rapid-cycling signals sent during the pre-cycle warm-up for the fuel injectors, which rapid-cycling signals, for example, may cause the fuel injector's spool to overcome stiction force and break loose of the initial resistance to movement, for example, at low temperatures.

Figure 2:
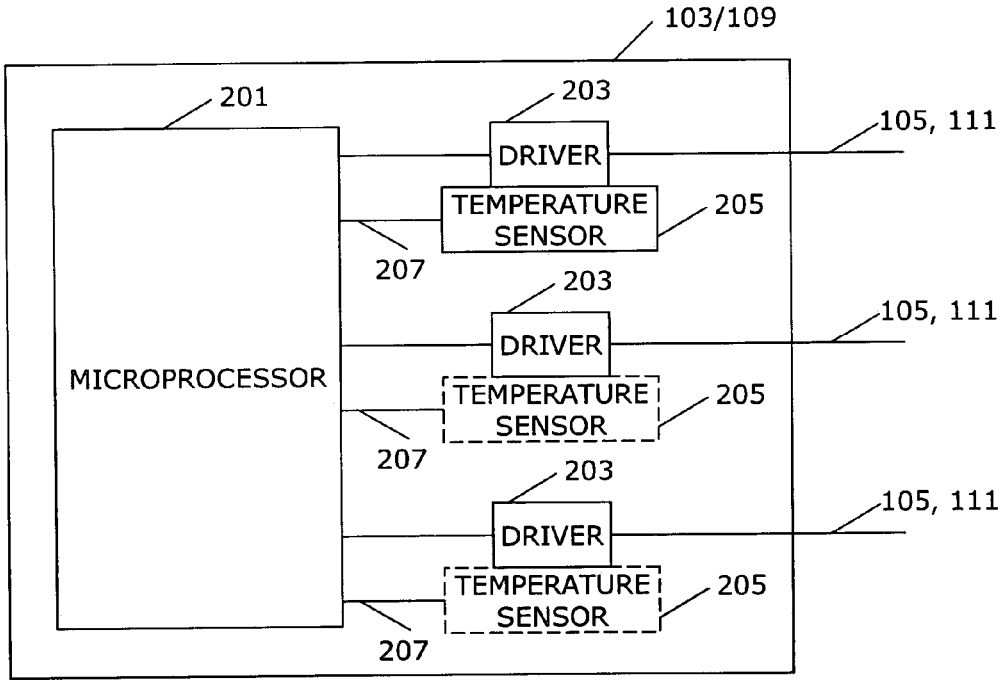
FIG. 2 is a block diagram illustrating a driver controller in accordance with the invention.

A block diagram illustrating a driver controller 103/109 is shown in FIG. 2. The driver controller 103 or 109 utilizes a microprocessor 201 to run a predetermined program to provide desired functionality based on signals received at or generated by the microprocessor 201, as known in the art. One of the functions of the microprocessor 201 is to send signals to various drivers 203 that provide a signal 105 or 111 in the form of a voltage and current for a duration of time to the electronic component 107 or 113 that is to be controlled.

One or more temperature sensors 205 may be utilized in conjunction with the drivers 203. Each temperature sensor 205 may be a stand-alone thermocouple that is disposed on one or more drivers 203 or may be a built-in temperature sensor that is integral to one or more drivers 203. The temperature sensor 205 monitors the temperature of its associated driver 203, and sends the temperature as a signal 207 to the microprocessor 201. The microprocessor 201 may act on the temperature signal 207 itself or may relay the temperature signal 207 to another module. For example, the IDM 109 may process the temperature signal 207 and/or may relay the temperature signal 207 to the ECM 103. The appropriate microprocessor 201 interprets the temperature signal 207 in light of one or more temperature conditions. The temperature signal 207 may also be utilized to determine if a specific component 107 or 113 is operating. For example, if the component 107 or 113 is not operating, it may cause the driver 203 to either overheat or provide no power, in which case the temperature would be lower than expected. When temperature signals 207 from different components either overheat or provide no power, in which case the temperature would be lower than expected. When temperature signals 207 from different components of the same type are compared, a component 107 or 113 of the same type are compared, a component 107 or 113 that is not functioning correctly is likely to have a substantially different temperature.

When one or more temperature conditions are exceeded, the microprocessor 201 reduces pre-cycle warm-up for the electronic component 107 or 113 associated with the driver 203 that exhibited the excessive temperature condition. When the driver 203 for a component 107 or 113 has exceeded a temperature condition, such as an absolute temperature or a temperature differential, the driver 203 is presumed to be warm enough from recently driving the electronic components 107 or 113, which are in turn presumed to be warm enough from being electronically driven. Thus, reducing pre-cycle warm-up when the engine is cranked helps to prevent the components from premature burn-out due to excess warm-up.

The drivers 203 may be, for example, field effect transistors with a built-in temperature sensor 205 or drivers with a temperature sensor 205 disposed thereon, as are known in the art. By utilizing temperature sensors 205 within the controller 103 or 109, rather than utilizing temperature sensors outside the controller 103 or 109, e.g., on the electronic components 107 or 111, the need for providing a return path for temperature data from the devices 107 or 111 onto the controller 103 or 109 is alleviated. When multiple devices 103 or 109 are controlled in this matter, utilizing temperature sensors 205 on-board the controller 103 or 109 alleviates the need to bring multiple lines into the controller 103 or 109.

Although one temperature sensor 205 is shown for each driver 203, fewer than one temperature sensor 205 for each driver 203 may be utilized. For example, one or more temperature sensors 205 may be utilized for each type of electronic component 107 or 113. For example, if six glow plugs 107 are utilized in the engine 101, one or two temperature sensors 205 may be placed on one or two of the six drivers 203 for the glow plugs 107, instead of placing six temperature sensors 205, one on each of the six drivers for the six glow plugs 107. When the temperature threshold for any driver 203 is exceeded, the pre-cycle warm-up for all six glow plugs 107 is reduced. Similarly, one or more temperature sensors 205 may be utilized to determine whether to reduce the pre-cycle warm-up for one or more fuel injector coils or any other electronic components for which protection is desired.

Figure 3:
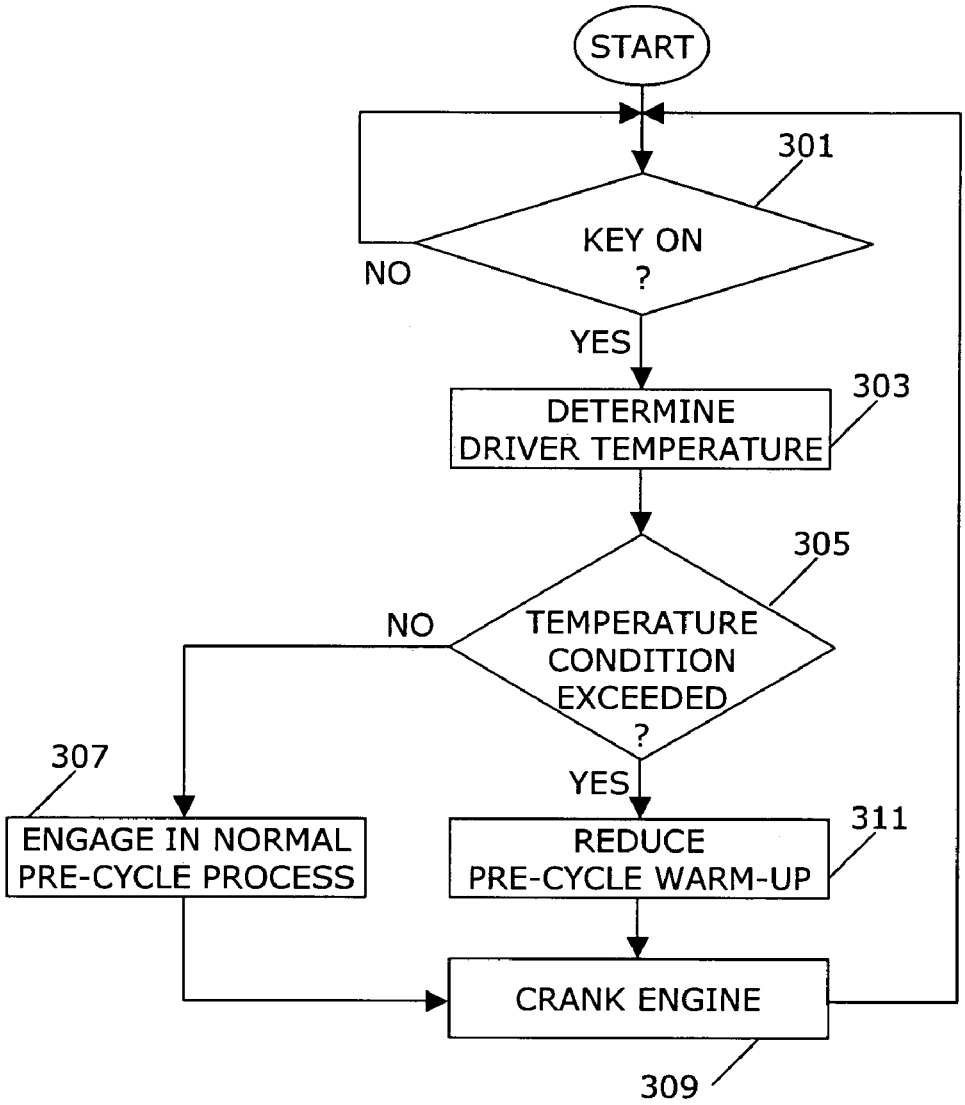
FIG. 3 is a flowchart illustrating a method of reducing pre-cycle warm-up for an electronic component in accordance with the invention.

A flowchart illustrating a method of reducing pre-cycle warm-up for an electronic component is shown in FIG. 3. At step 301, the process attempts to detect a key-on ignition condition for the ignition key or ignition switch for an engine. When a key-on condition is detected, the process continues with step 303. The temperature of one or more drivers 203 is determined at step 303. The temperature is determined by one or more temperature sensors 205, which send one or more signals to a microprocessor 201.

At step 305, it is determined whether a temperature condition is exceeded. Exceeding a temperature condition includes exceeding a temperature differential and/or exceeding an absolute temperature. For example, the driver 203 temperature from a temperature sensor 205 may be compared to a reference temperature for something other than the driver 203, such as ambient temperature, oil temperature for the engine, or coolant temperature for the engine, and when the temperature differential (the difference between the driver 203 temperature and reference temperature) is greater than a predetermined threshold, e.g., 50 degrees C., the pre-cycle warm-up for the electronic component 107 or 113 (or component type) associated with the driver 203 for that sensor 205 is reduced. Alternatively, an absolute temperature may be compared to the temperature from the sensor 205, and when the driver 203 temperature exceeds the absolute temperature, e.g., 100 degrees C., the pre-cycle warm-up for the electronic component 107 or 113 (or component type) associated with the driver 203 for that sensor 205 is reduced.

The temperature condition may be advantageously selected such that a component 107 or 113 or driver 203 is considered to be warm enough, such that further pre-cycle warm-up may be reduced or eliminated, although the component 107 or 113 may be significantly below a temperature condition that may result in damage to the component 107 or 113. By reducing pre-cycle warm-up well before a condition where damage may result wear and tear on the component is likely to be reduced, and the life of the component may be extended.

Various different temperature conditions at step 305 may result in various different levels of reduced pre-cycle warm-up. Thus, each time step 305 is encountered or at various different temperature conditions, a different level of reduced pre-cycle warm-up may result. The amount of pre-cycle warm-up reduction may be based on the temperature condition. Higher temperature conditions, for example, result in greater pre-cycle warm-up reduction than lower temperature conditions. For example, a five different levels of reduced pre-cycle warm-up may take place at five different temperature conditions. For example, each level may reflect a different pre-cycle warm-up time, e.g., 10 seconds, 8 seconds, 6 seconds, 4 seconds, and 0 seconds for no pre-cycle warm-up. Alternatively, each level may include a different pre-cycle warm-up current, with the lowest current as zero for no pre-cycle warm-up. Pre-cycle warm-up current and pre-cycle warm-up time may be reduced in various combinations, where current and/or time may be reduced at various levels.

When a temperature condition is not exceeded, the process continues with step 307, where the normal pre-cycle process for the relevant electronic component 107 or 113 is engaged, and the engine is cranked at step 309.

When a temperature condition is exceeded at step 305, the pre-cycle warm-up process for the relevant electronic component 107 or 113 (or component type) is reduced at step 311. Reduction of pre-cycle warm-up includes reducing the amount of time for pre-cycle warm-up by a finite amount of time, reducing the amount of current utilized for pre-cycle warm-up by a finite amount of current, temporarily eliminating pre-cycle warm-up, i.e., temporarily completely inhibiting pre-cycle warm-up or temporarily reducing the amount of pre-cycle warm-up time to zero, and so forth. The amount of reduction in pre-cycle warm-up may also be temperature based. For example, when a temperature differential of 35 degrees C. or an absolute temperature of 75 degrees C. is reached, the pre-cycle warm-up may be cut in half, e.g., half the time or half the current, or a reduction in both. And when a temperature differential of 50 degrees C. or an absolute temperature of 100 degrees C. is reached, the pre-cycle warm-up may be eliminated, e.g., the time is reduced to zero. The temperature sensor 205 information may also be utilized to determine overheating conditions for the controller 103/109. When the controller 103/109 exceeds a controller temperature condition, such as an absolute temperature of the temperature of one or more of the drivers 203 within the controller 103/109, the power output of the drivers 203 within the controller 103/109 may be reduced to allow the engine 101 to continue running at reduced output. When the engine is cranked at step 309 following step 311, the time to wait for engine crank is either reduced or eliminated.

Although the above description utilized the examples of fuel injector coils and glow plugs, the present invention is readily applicable to other devices, such as air intake heaters, fuel heaters, electromechanical devices requiring pre-cycling, and so forth.

The present invention provides a temperature sensor for a driver for an electronic component in order to reduce pre-cycle warm-up for the component when a temperature condition is exceeded, thereby preventing excess heat from building up and damaging the electronic component, reducing wear and tear on the component, extending the life of the component, and/or reducing the time before the engine cranks. The internal combustion engine is allowed to crank sooner, especially when pre-cycle warm-up is eliminated completely upon determining that the temperature of the electronic component exceeds the temperature condition. By locating the temperature sensors with the drivers and in the controller, the need for additional paths to the controller is avoided. One temperature sensor may be utilized to reduce pre-cycle warm-up for a plurality of electronic components. Multiple temperature sensors may be utilized to provide back-up in case a temperature sensor malfunctions. By using relatively inexpensive temperature sensor(s), the need for expensive self-regulating glow plugs may be avoided. The temperature sensors may also be utilizes to prevent a controller, such as an ECM or IDM, from overheating or to detect components that are not operating correctly.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method comprising the steps of:

determining when a key-on ignition condition for an internal combustion engine occurs;

determining a temperature for a first electronic component that drives a second electronic component;

when the temperature for the first electronic component exceeds a temperature condition, reducing pre-cycle warm-up for the second electronic component, wherein the temperature condition is between a first temperature condition when a second electronic component is warm and a second temperature condition below which the second electronic component is damaged.

2. The method of claim 1, wherein the second electronic component is one of a fuel injector coil and a glow plug.

3. The method of claim 1, further comprising the step of reducing pre-cycle warm-up for at least a third electronic component, wherein the second electronic component is not the third electronic component, and wherein the first electronic component drives the second electronic component and the first electronic component does not drive the third electronic component.

4. The method of claim 1, further comprising the step of allowing the internal combustion engine to crank without waiting for pre-cycle warm-up upon determining that the temperature of the first electronic component exceeds the temperature condition.

5. The method of claim 1, further comprising the steps of:

when the temperature of the electronic component does not exceed the temperature condition, completing pre-cycle warm-up for the second electronic component;

allowing the engine to crank.

6. The method of claim 1, wherein the temperature condition is a temperature differential between the temperature for the first electronic component and a temperature of something other than the first electronic component.

7. The method of claim 1, wherein the temperature condition is a temperature differential between the temperature for the first electronic component and one of ambient temperature, oil temperature for the internal combustion engine, and coolant temperature for the internal combustion engine.

8. The method of claim 1, wherein the temperature condition is an absolute temperature.

9. The method of claim 1, wherein the step of reducing pre-cycle warm-up comprises the step of reducing pre-cycle warm-up time to a non-zero time.

10. The method of claim 1, wherein the step of reducing pre-cycle warm-up comprises the step of temporarily inhibiting pre-cycle warm-up.

11. The method of claim 1, wherein the step of reducing pre-cycle warm-up comprises the step of reducing pre-cycle warm-up current to a non-zero current.

12. The method of claim 1, wherein pre-cycle warm-up for the second electronic component is reduced by a first amount at a first temperature condition of a plurality of temperature conditions and wherein pre-cycle warm-up for the second electronic component is reduced by a second amount at a second temperature condition of the plurality of temperature conditions.

13. A method comprising the steps of:

determining when a key-on ignition condition for an internal combustion engine occurs;

determining a temperature for a first electronic component that drives a second electronic component;

when the temperature for the first electronic component falls between a first temperature condition when the second electronic component is warm and a second temperature condition below which the second electronic component is damaged, reducing pre-cycle warm-up for the second electronic component.

14. An apparatus comprising:

a driver capable of driving an electronic component for an internal combustion engine;

a temperature sensor arranged and constructed to determine a temperature of the driver when a key-on ignition condition for the internal combustion engine occurs;

a driver controller, arranged and constructed to control the driver, to receive the temperature of the driver, and when the temperature of the driver exceeds a temperature condition related to the electronic component, to reduce pre-cycle warm-up of the electronic component, wherein the temperature condition is between a first temperature condition when the electronic component is warm and a second temperature condition below which the electronic component is damaged.

15. The apparatus of claim 14, wherein the electronic component is one of a fuel injector coil and a glow plug.

16. The apparatus of claim 14, wherein the temperature sensor is built-in to the driver.

17. The apparatus of claim 14, wherein the temperature sensor is disposed on the driver.

18. The apparatus of claim 14, wherein the driver controller is further arranged and constructed to complete pre-cycle warm-up of the electronic component when engine crank is detected and the temperature of the driver does not exceed the temperature condition.

19. The apparatus of claim 14, wherein the temperature condition is a temperature differential between the temperature for the electronic component and a temperature of something other than the electronic component.

20. The apparatus of claim 14, wherein the temperature condition is an absolute temperature.

21. The apparatus of claim 14, wherein the driver controller reduces pre-cycle warm-up by reducing pre-cycle warm-up time to a non-zero time.

22. The apparatus of claim 14, wherein the driver controller reduces pre-cycle warm-up by temporarily eliminating pre-cycle warm-up.

23. The apparatus of claim 14, wherein the driver controller reduces pre-cycle warm-up by reducing pre-cycle warm-up current to a non-zero current.

24. The apparatus of claim 14, wherein the driver controller is further arranged and constructed to reduce pre-cycle warm-up for one or more electronic components not controlled by the driver when the temperature of the driver exceeds a controller temperature condition.

25. The apparatus of claim 14, wherein pre-cycle warm-up for the second electronic component is reduced by a first amount at a first temperature condition of a plurality of temperature conditions, and wherein pre-cycle warm-up for the second electronic component is reduced by a second amount at a second temperature condition of the plurality of temperature conditions.

* * * * *